US009482213B2

(12) United States Patent
Charlton

(10) Patent No.: US 9,482,213 B2
(45) Date of Patent: Nov. 1, 2016

(54) COMMON MODE PULSE DAMPER FOR RECIPROCATING PUMP SYSTEMS

(71) Applicant: Bio-Rad Laboratories, Hercules, CA (US)

(72) Inventor: Chris Charlton, Martinez, CA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 808 days.

(21) Appl. No.: 13/656,072

(22) Filed: Oct. 19, 2012

(65) Prior Publication Data

US 2013/0098456 A1 Apr. 25, 2013

Related U.S. Application Data

(60) Provisional application No. 61/550,598, filed on Oct. 24, 2011.

(51) Int. Cl.
*F04B 11/00* (2006.01)
*F04B 43/02* (2006.01)

(52) U.S. Cl.
CPC ..... *F04B 11/00* (2013.01); *F04B 11/0008* (2013.01); *F04B 43/02* (2013.01); *Y10T 137/0318* (2015.04); *Y10T 137/86035* (2015.04)

(58) Field of Classification Search
CPC . F04B 11/00; F04B 11/0008; F04B 11/0016; F04B 11/0033; F04B 39/0027; F04B 43/02; Y10T 137/0318; Y10T 137/86035
USPC ..... 417/540; 137/98, 100, 565.33; 138/26, 138/30
See application file for complete search history.

(56) References Cited

U.S. PATENT DOCUMENTS

| | | | | |
|---|---|---|---|---|
| 2,736,332 | A * | 2/1956 | Simmons | F15B 7/10 137/100 |
| 2,951,450 | A * | 9/1960 | Fisher | 417/273 |
| 4,222,414 | A | 9/1980 | Achener | |
| 4,234,427 | A | 11/1980 | Boehme | |
| 4,313,464 | A | 2/1982 | Major | |
| 4,387,736 | A | 6/1983 | Major | |
| RE31,480 | E | 1/1984 | Major | |
| 4,427,029 | A | 1/1984 | Charney et al. | |
| 4,453,898 | A | 6/1984 | Leka et al. | |
| 4,548,713 | A | 10/1985 | Schmid | |
| 4,595,496 | A | 6/1986 | Carson | |
| 2003/0164161 | A1 * | 9/2003 | Usui | F02M 55/04 123/510 |

* cited by examiner

*Primary Examiner* — Charles Freay
*Assistant Examiner* — Philip Stimpert
(74) *Attorney, Agent, or Firm* — Kilpatrick Townsend & Stockton LLP

(57) ABSTRACT

Pulses in a pumping system resulting from paired reciprocating pumps are dampened by a pressure vessel that includes two compartments separated by a flexible membrane and otherwise isolated from each other.

12 Claims, 2 Drawing Sheets

COMMON MODE PULSE DAMPER FOR RECIPROCATING PUMP SYSTEMS

CROSS-REFERENCE TO RELATED APPLICATION

This application claims the benefit of U.S. Provisional Patent Application No. 61/550,598, filed Oct. 24, 2011, the contents of which are incorporated herein by reference in their entirety.

BACKGROUND OF THE INVENTION

1. Field of the Invention

This invention lies in the field of pulse dampers for reciprocating pumps.

2. Description of the Prior Art

Certain laboratory systems, prominent among which are high-performance liquid chromatography (HPLC) systems, require a continuous and steady flow of liquid. In HPLC, the continuous and steady flow assures that the chromatogram for any given sample will be readily readable and sufficiently standardized so that components can be identified by their retention times, properly quantified if desired, and generally reproducible. A dual-headed reciprocating pump system is often used to produce the flow, and a common example of such a system is one with two pump chambers, each with its own piston but with the pistons coordinated by a common motor to drive the pistons in alternating manner. A common problem with dual-headed reciprocating systems is the occurrence of pressure pulsations that occur when the system switches over from one piston to the other. Pressure pulsations cause pulsations in the output flow, and hence the flow rate of the output flow, from the system. When the liquid is a mixture formed by combining two liquids of different compositions either outside of or within the pump chambers, the resulting mixture will often contain ripples in its composition, i.e., fluctuations in the proportion of one liquid relative to the other downstream of the mixing site, in addition to pressure pulsations. Composition ripples occur at elevated pumping pressures and are the result of compression and decompression of the fluid in each pump at the beginning and end of each stroke, respectively. Dampers can be added to individual pumps to dampen the pressure pulsations, but the composition ripples often remain.

SUMMARY OF THE INVENTION

The present invention resides in a pressure vessel that reduces, and in many cases eliminates entirely, both pressure pulsations and composition ripples in the output of a dual-headed reciprocating pump. The invention also resides in a dual-headed reciprocating pump that includes such a pressure vessel, and further resides in a method of continuously pumping fluid by use of such a dual-headed reciprocating pump and pressure vessel. The pressure vessel is a single enclosure with two flow-through compartments that are closed from each other so that liquid from one compartment does not enter the other and liquids flow independently through both compartments. Each compartment has its own inlet port and outlet port to allow discharges from the two pump chambers to pass through the compartments separately, and the two compartments are separated by a diaphragm that is fluid-impermeable and yet flexible. The diaphragm responds to surges or other variations in pressure from either side by flexing and thereby allows both momentary pressure surges and momentary drops in pressure to be absorbed within the vessel and removed from the liquid leaving the vessel. In certain embodiments of the invention, the pressure vessel contains two such diaphragms with a volume between them that is filled with compressible fluid. Pressure variations can then be absorbed by the compressible fluid as well as both diaphragms.

DETAILED DESCRIPTION OF THE INVENTION AND SELECTED EMBODIMENTS

The term "flexible" as used herein in connection with the diaphragm(s), refers to diaphragms that can bow or bend in either direction in response to pressure differentials, as well as diaphragms that are elastic and can therefore stretch in response to pressure differentials. The term "fluid-impermeable" denotes diaphragms that do not allow the passage of either liquid or gas at the fluid pressures at which the pumps typically operate. Diaphragms made of a wide array of polymers that meet these descriptions are available and well known in the art. For embodiments of the invention involving the use of a compressible fluid, the fluid can be a gas or a liquid at operating temperatures; such fluids are likewise well known in the art. Examples of compressible liquids are isopropyl alcohol and silicone oil. Examples of compressible gases are air, nitrogen, and any other common gas. Liquids and gases that are not flammable are preferred.

The two pump chambers and their associated pistons can be motor-driven syringe pumps, or any such pumps that have a limited chamber volume and are refilled by the system between each discharge. The pistons will typically operate in a smooth manner, i.e., at constant velocity, although deceleration will typically occur at the beginning and end of each stroke, contributing to the pressure pulsations and composition ripples that are addressed by the present invention. Once the diaphragm(s) or the compressible fluid, or both, are stressed at the beginning or end of a stroke, the stressed component, be it diaphragm or fluid, will induce a flow of its own to compensate for the aberration in the flow entering the pressure vessel. The reciprocating motion of the two pistons is achieved by a common motor such as one with a cam drive, and in some cases a cam of elliptical shape to produce overlap in the changeover between pump chambers.

The figures attached hereto and the following descriptions refer to one example of a reciprocating pump and pressure vessel in accordance with the present invention.

Figure 1:
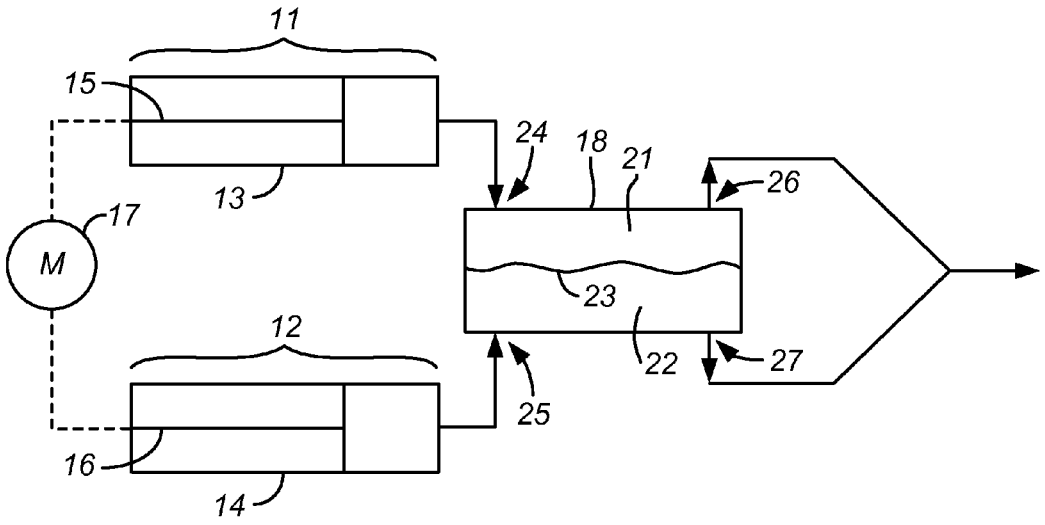
FIG. 1 is a diagrammatic representation of one example of a reciprocating pump system in accordance with the present invention.

FIG. 1 is a representative diagram of a reciprocating pump system that includes two syringe pumps 11, 12, each having a barrel 13, 14 and a piston 15, 16, the two pistons driven by a common motor 17 in reciprocating manner. Neither the inlet lines to the pump barrels nor the sources of fluid to the barrels are shown, since they are all of conventional construction, and suitable examples are well known to those of skill in the art. The pistons 15, 16 are presented in a rudimentary although representative manner, as are all other features of the Figures. The discharges of the two barrels are connected to the pressure vessel 18 whose interior is divided into two compartments 21, 22 sealed off from each other by a flexible diaphragm 23. Each compartment thus has its own inlet port 24, 25 and its own outlet port 26, 27.

Figure 2:
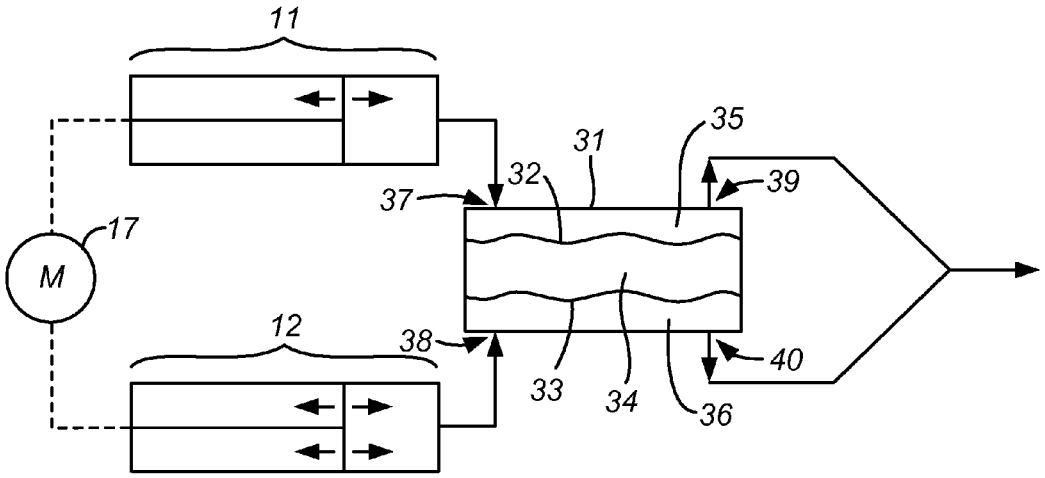
FIG. 2 is a diagrammatic representation of another example of a reciprocating pump system in accordance with the present invention.

FIG. 2 is a representative diagram of another reciprocating pump, identical to that of FIG. 1 except for the pressure vessel 31 which contains two diaphragms 32, 33 instead of one, and a compressible fluid 34 between the diaphragms. As in the pump system of FIG. 1, the pressure vessel 31 contains two internal compartments 35, 36, one on each side of the compressible fluid compartment. The two compartments 35, 36 are sealed off from each other so that no fluid can pass from one to the other, and each of the two outer compartments 35, 36 has its own inlet ports 37, 38 and its own outlet ports 39,40. All other components are the same as those of FIG. 1.

Figure 3A:
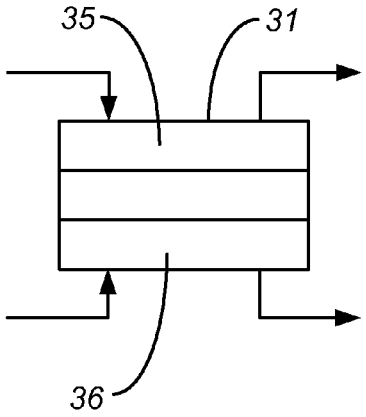
FIG. 3A is a diagrammatic representation of the pressure vessel for the pump system of FIG. 2 in a first stage of operation.
Figure 3B:
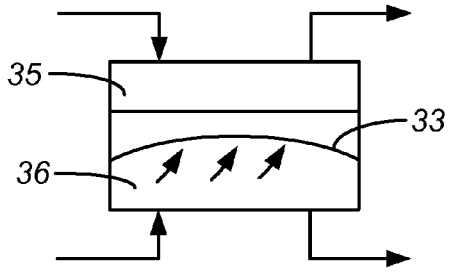
FIG. 3B shows the pressure vessel in a second stage of operation.
Figure 3C:
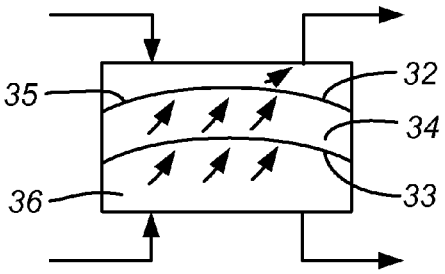
FIG. 3C shows the pressure vessel in a third stage of operation.
Figure 3D:
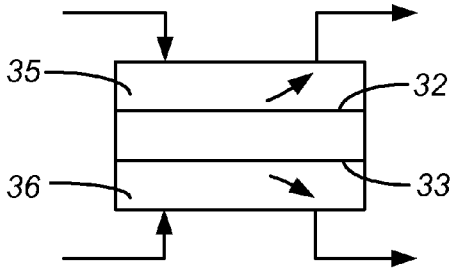
FIG. 3D shows the pressure vessel in a fourth stage of operation.

FIGS. 3A, 3B, 3C, and 3D depict the pressure vessel 31 of the pump system of FIG. 2 in four stages of operation, respectively. In FIG. 3A, the system is in steady state. In FIG. 3B, a positive pressure surge from the syringe pump whose discharge passes through the lower compartment 36 of the pressure vessel causes a deflection in the lower diaphragm. In FIG. 3C, the pressure surge is transmitted through the compressible fluid 34 to the upper compartment 35. In FIG. 3D, both diaphragms return to their relaxed positions, urging fluid out of both outlet ports.

In the claims appended hereto, the term "a" or "an" is intended to mean "one or more." The term "comprise" and variations thereof such as "comprises" and "comprising," when preceding the recitation of a step or an element, are intended to mean that the addition of further steps or elements is optional and not excluded. All patents, patent applications, and other published reference materials cited in this specification are hereby incorporated herein by reference in their entirety. Any discrepancy between any reference material cited herein or any prior art in general and an explicit teaching of this specification is intended to be resolved in favor of the teaching in this specification. This includes any discrepancy between an art-understood definition of a word or phrase and a definition explicitly provided in this specification of the same word or phrase.

What is claimed is:

1. A pressure vessel for use at outlets of two piston pumps, said pressure vessel comprising a first flow-through compartment with a first inlet port and a first outlet port, and a second flow-through compartment with a second inlet port and a second outlet port, said first and second flow-through compartments separated and sealed from each other by a diaphragm that is flexible and impermeable to fluid, wherein first and second fluid conduits connected respectively to the first and second outlet ports are in direct fluid communication with a common outlet in which fluids from the two piston pumps are combined.

2. The pressure vessel of claim 1 wherein said diaphragm is defined as a first diaphragm, and said first and second flow-through compartments are separated and sealed from each other by said first diaphragm and a second diaphragm that is flexible and impermeable to fluid, said first and second diaphragms bordering a closed compartment inside said pressure vessel between said first flow-through compartment and said second flow-through compartment, said closed compartment filled with a compressible fluid and positioned such that pressure variations in either of said first and second compartments are at least partially absorbed by said compressible fluid.

3. A dual-headed reciprocating pump comprising:

first and second pump chambers containing first and second pistons, respectively, a drive motor connected to said first and second pistons to drive said first and second pistons in alternating sequence, and a pressure vessel comprising a first flow-through compartment with a first inlet port and a first outlet port, and a second flow-through compartment with a second inlet port and a second outlet port, said first inlet port arranged to directly receive into said first flow-through compartment fluid discharged from said first pump chamber, and said second inlet port arranged to directly receive into said second flow-through compartment fluid discharged from said second pump chamber, said first and second flow-through compartments separated and sealed from each other by a diaphragm that is flexible and impermeable to fluid.

4. The dual-headed reciprocating pump of claim 3 wherein said diaphragm is defined as a first diaphragm, and said first and second flow-through compartments are separated by said first diaphragm and a second diaphragm that is flexible and impermeable to fluid, said first and second diaphragms bordering a closed compartment inside said pressure vessel between said first flow-through compartment and said second flow-through compartment, said closed compartment filled with a compressible fluid and positioned such that pressure variations in either of said first and second compartments are at least partially absorbed by said compressible fluid.

5. A method for continuously pumping fluid, said method comprising:

supplying said fluid to first and second pump chambers in alternating sequence and driving first and second pistons within said first and second pump chambers, respectively, to discharge fluid from said first and second pump chambers in alternating sequence, and passing fluid discharged from said first pump chamber directly into an inlet port of a first flow-through compartment of a pressure vessel and passing fluid discharged from said second pump chamber directly into an inlet port of a second flow-through compartment of said pressure vessel, said first and second flow-through compartments separated and sealed from each other by a diaphragm that is flexible and impermeable to fluid, said diaphragm thereby dampening pressure pulsations in said discharged fluids arising when a discharge from one of said first and second pump chambers is succeeded by a discharge from the other of said first and second pump chambers.

6. The method of claim 5 wherein said diaphragm is defined as a first diaphragm, and said first and second flow-through compartments are separated by said first diaphragm and a second diaphragm that is flexible and impermeable to fluid, said first and second diaphragms bordering a closed compartment inside said pressure vessel between said first flow-through compartment and said second flow-through compartment, said closed compartment filled with a compressible fluid and positioned such that said pressure pulsations are at least partially dampened by said compressible fluid.

7. A pressure vessel for use at outlets of two piston pumps, said pressure vessel comprising a first flow-through compartment with a first inlet port and a first outlet port, and a second flow-through compartment with a second inlet port and a second outlet port, said first and second flow-through compartments separated and sealed from each other by a diaphragm that is flexible and impermeable to fluid, wherein each of the first and second inlet ports is arranged to directly receive fluid discharged from a respective one of the two piston pumps.

8. The pressure vessel of claim 7 wherein said diaphragm is defined as a first diaphragm, and said first and second flow-through compartments are separated and sealed from each other by said first diaphragm and a second diaphragm that is flexible and impermeable to fluid, said first and second diaphragms bordering a closed compartment inside said pressure vessel between said first flow-through compartment and said second flow-through compartment, said closed compartment filled with a compressible fluid and positioned such that pressure variations in either of said first and second compartments are at least partially absorbed by said compressible fluid.

9. A dual-headed reciprocating pump comprising:

first and second pump chambers containing first and second pistons, respectively, a drive motor connected to said first and second pistons to drive said first and second pistons in alternating sequence, and a pressure vessel having a first side and a second side, the pressure vessel comprising a first flow-through compartment with a first inlet port and a first outlet port, and a second flow-through compartment with a second inlet port and a second outlet port, said first inlet port positioned on the first side of the pressure vessel and arranged to directly receive fluid discharged from said first pump chamber, and said second inlet port positioned on the first side of the pressure vessel and arranged to directly receive fluid discharged from said second pump chamber, said first and second flow-through compartments separated and sealed from each other by a diaphragm that is flexible and impermeable to fluid.

10. The dual-headed reciprocating pump of claim 9 wherein said diaphragm is defined as a first diaphragm, and said first and second flow-through compartments are separated by said first diaphragm and a second diaphragm that is flexible and impermeable to fluid, said first and second diaphragms bordering a closed compartment inside said pressure vessel between said first flow-through compartment and said second flow-through compartment, said closed compartment filled with a compressible fluid and positioned such that pressure variations in either of said first and second compartments are at least partially absorbed by said compressible fluid.

11. A dual-headed reciprocating pump comprising:

first and second pump chambers containing first and second pistons, respectively, a drive motor connected to said first and second pistons to drive said first and second pistons in alternating sequence, and a pressure vessel comprising a first flow-through compartment with a first inlet port and a first outlet port, and a second flow-through compartment with a second inlet port and a second outlet port, said first inlet port arranged to directly receive fluid discharged from said first pump chamber, and said second inlet port arranged to directly receive fluid discharged from said second pump chamber, said first and second flow-through compartments separated and sealed from each other by a diaphragm that is flexible and impermeable to fluid, wherein fluid flows through the first flow-through compartment in the same direction as fluid flows through the second flow-through compartment.

12. The dual-headed reciprocating pump of claim 11 wherein said diaphragm is defined as a first diaphragm, and said first and second flow-through compartments are separated by said first diaphragm and a second diaphragm that is flexible and impermeable to fluid, said first and second diaphragms bordering a closed compartment inside said pressure vessel between said first flow-through compartment and said second flow-through compartment, said closed compartment filled with a compressible fluid and positioned such that pressure variations in either of said first and second compartments are at least partially absorbed by said compressible fluid.

* * * * *